US005713780A

United States Patent [19]

Gallagher

[11] Patent Number: 5,713,780

[45] Date of Patent: Feb. 3, 1998

[54] WALKING TOY ANIMAL

[75] Inventor: Laurie S. Gallagher, Chicago, Ill.

[73] Assignee: Cap Toys, Inc., Bedford Heights, Ohio

[21] Appl. No.: 769,712

[22] Filed: Dec. 18, 1996

Related U.S. Application Data

[63] Continuation of Ser. No. 559,628, Nov. 20, 1995, abandoned.

[51] Int. Cl.[6] ..... A63H 7/02

[52] U.S. Cl. ..... 446/364; 446/316; 446/317; 446/365; 446/369; 446/377

[58] Field of Search ..... 446/316, 317, 446/359, 361, 364, 365, 366, 369, 377, 378, 486, 308, 309, 312, 330, 371, 382, 383

[56] References Cited

U.S. PATENT DOCUMENTS

| | | | |
|---|---|---|---|
| 2,636,317 | 4/1953 | Candee | 446/317 |
| 2,663,970 | 12/1953 | Brodrib | 446/317 |
| 2,824,409 | 2/1958 | Brodrib | 446/312 |
| 2,865,134 | 12/1958 | Cohn | 446/382 |
| 2,878,616 | 3/1959 | Sedlacek | 446/312 |
| 3,092,930 | 6/1963 | Resinol | 446/382 |
| 3,190,035 | 6/1965 | Armstrong | 446/364 |
| 3,831,313 | 8/1974 | Cichy | 446/369 |
| 4,816,002 | 3/1989 | Brodrib | 446/317 |
| 5,205,775 | 4/1993 | Brodrib | 446/317 |
| 5,323,875 | 6/1994 | Kennett . | |

FOREIGN PATENT DOCUMENTS

| | | | |
|---|---|---|---|
| 873797 | 7/1942 | France | 446/316 |

OTHER PUBLICATIONS

Bo–Bo the trick dog, advertisement, Toplay Products, Inc., date unknown.

*Primary Examiner*—Robert A. Hafer
*Assistant Examiner*—Jeffrey D. Carlson
*Attorney, Agent, or Firm*—Laff, Whitesel, Conte & Saret, Ltd.

[57] ABSTRACT

A walking toy animal in which the legs are hingedly connected to the body of the animal. The animal body is weighted to provide a low center of gravity. Located on the bottom of each leg is a material having a high degree of friction with its supporting surface whereby when the animal is pulled by a leash the animal will simulate a walking motion.

9 Claims, 3 Drawing Sheets

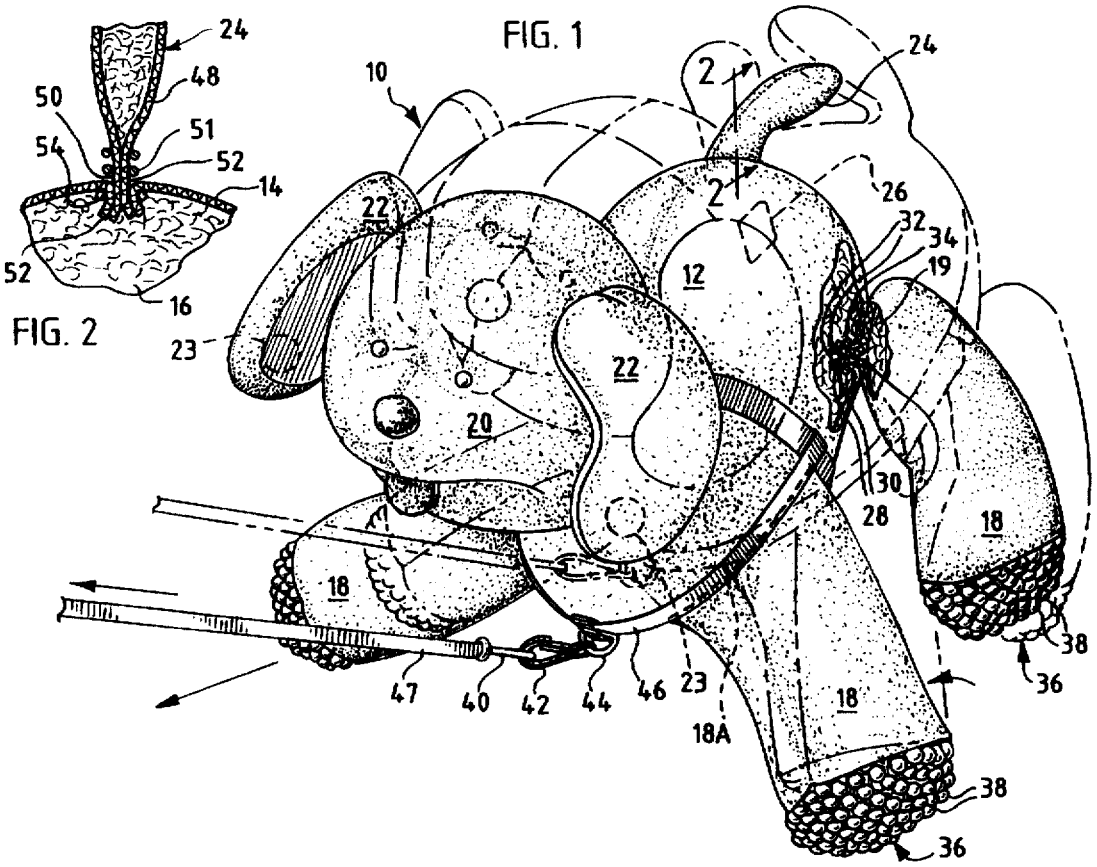
FIG. 1
FIG. 2
10
12
14
16
18
18A
19
20
22
23
24
26
28
30
32
34
36
38
40
42
44
46
47
48
50
51
52
54
2
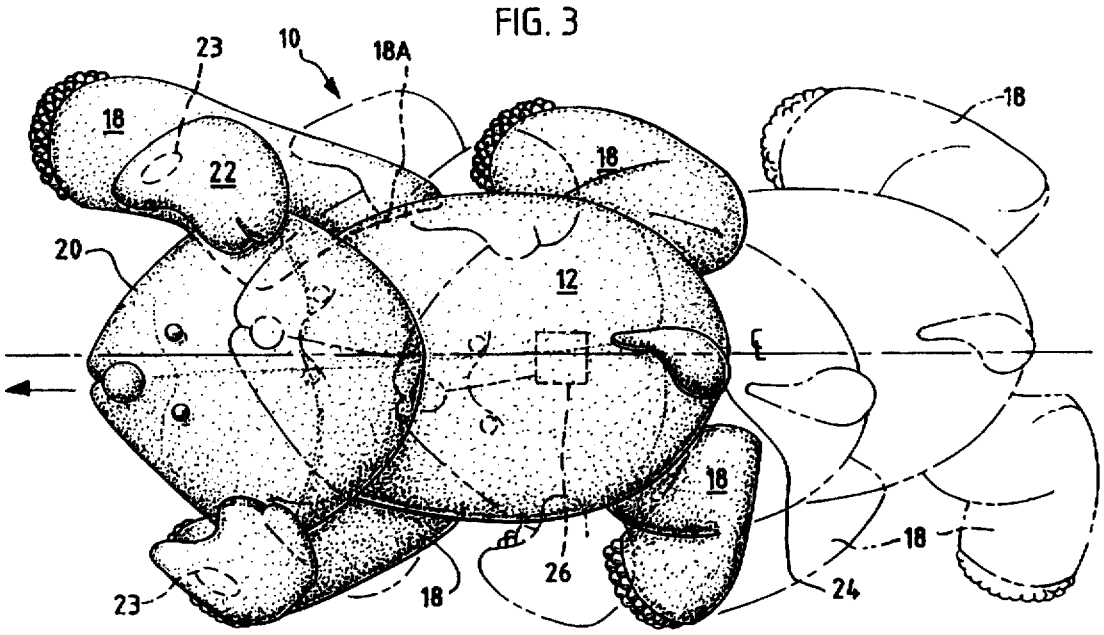
FIG. 3
10
12
18
18A
20
22
23
24
26

FIG. 4
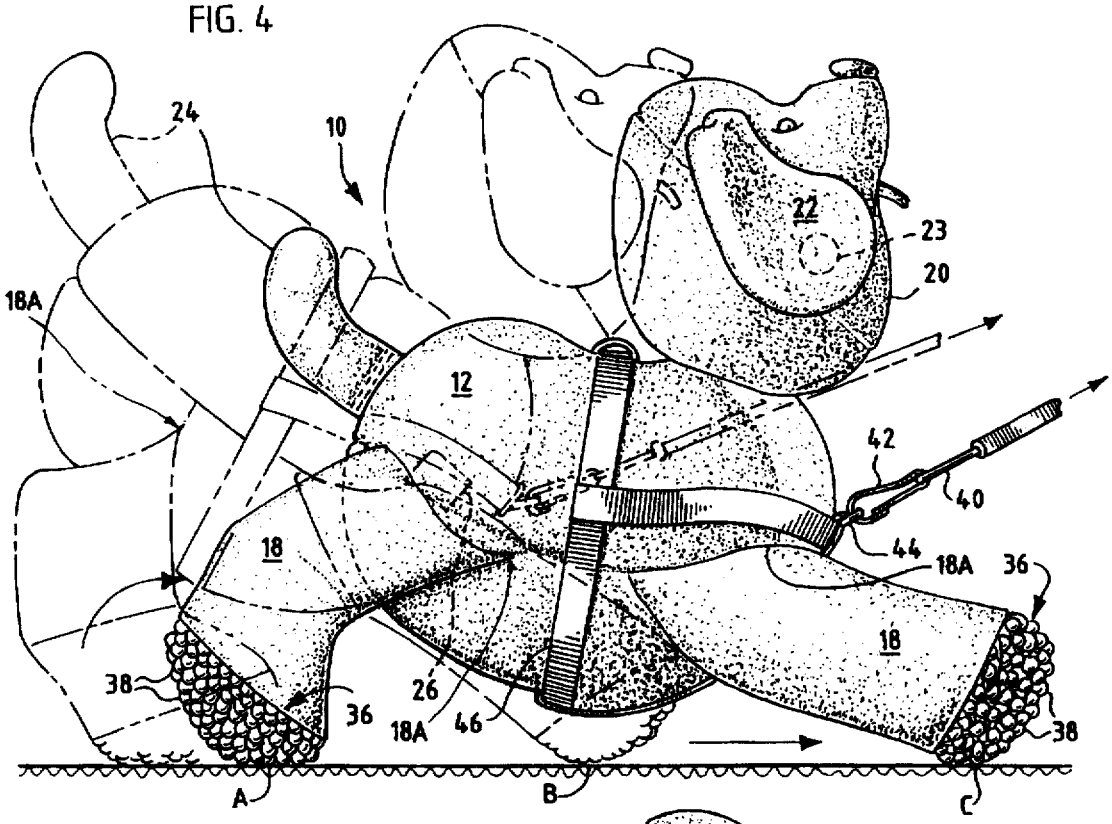
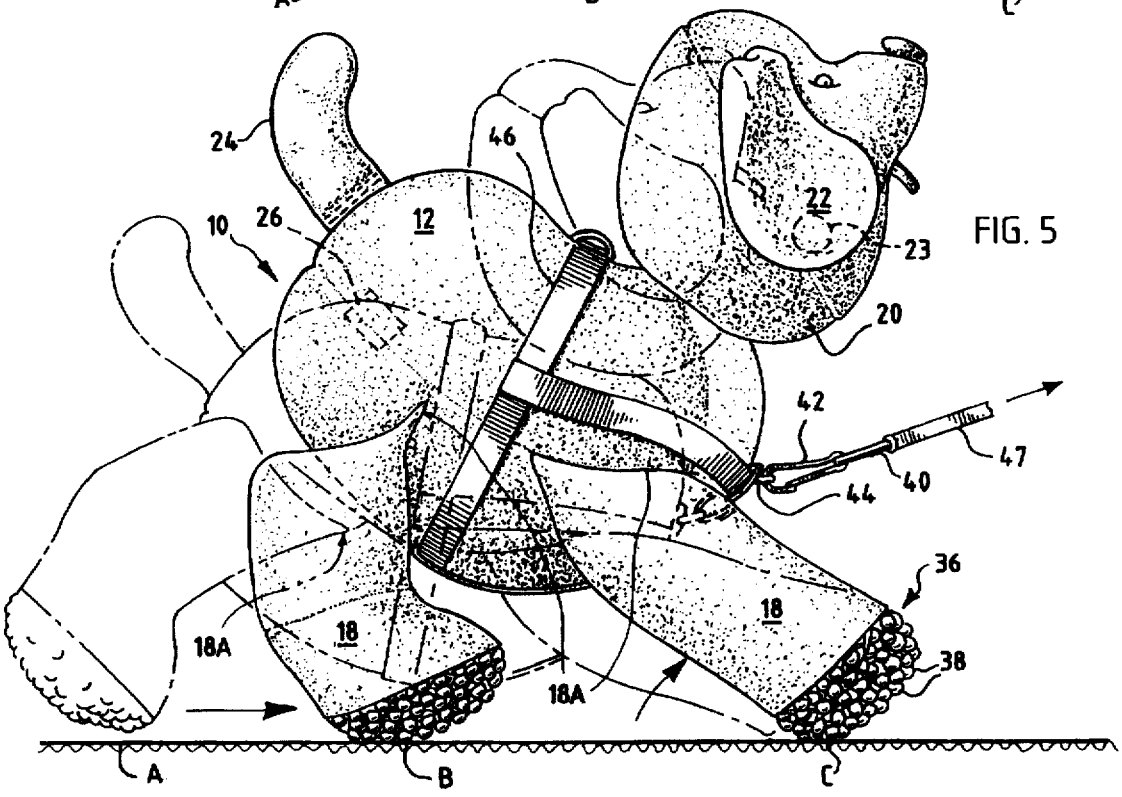
FIG. 5

WALKING TOY ANIMAL

PRIOR APPLICATION

This application is a continuation of U.S. patent application Ser. No. 08/559,628 filed on Nov. 20, 1995, abandoned.

FIELD OF THE INVENTION

This invention relates to a toy animal and particularly to one which, when pulled, will appear to walk in a manner generally comparable to the way in which a live animal, such as a puppy, would walk. The toy animal is relatively soft and without an internal skeleton. It has sufficient structural integrity so that it will maintain itself in an upright walking position when pulled by a leash or similar device.

BACKGROUND OF THE INVENTION

A typical huggable soft, cuddly type of toy animal such as a stuffed toy puppy dog with which a child may sleep is not structurally designed so as to be able to simulate a walking motion when pulled. A toy animal that is very rigid and which has stiff legs will move in a rigid fashion and thus will not provide a child with the natural feeling and comfort that occurs when one is walking a live animal. A small child, when pulling a toy animal such as a toy dog, wants to feel like he is walking a real dog. Thus when accompanying a parent walking a pet animal, it is desirable that the animal can behave in a manner similar to a live animal.

The current, soft cushioned or stuffed types of toy animals do not have a suitable juxtaposition of hinged elements and weight distribution so that when they are pulled they will act and perform like a live animal. Current comparable stuffed animals when pulled will merely drag along the ground. Therefore, it would be desirable to construct a huggable toy animal which will maintain its shape and which, when pulled along a floor or other horizontal surface, will move and walk in a manner similar to a live animal.

SUMMARY OF THE INVENTION

The toy animal of the instant invention is illustrated in the form of a small dog such as a puppy which is life-like in configuration and which, to a child, will move in a seemingly identical manner as a puppy. Other animals may be simulated as well, and references to toy dogs or puppies herein are merely intended as exemplary. A toy dog of the present invention has a body portion, head portion, four legs, and a tail and is very similar to a puppy. If built in accordance with the present invention, the toy will, when pulled, operate to walk in a manner very similar to a puppy.

The structure disclosed herein produces a unique movement of the toy animal as compared to toy animals of the prior art. Typically, prior art animals with legs which have been designed to simulate walking have used and relied on resilient members, such as springs in the legs, which, as they are stressed, store energy and which, when the restraining force is overcome, cause the legs to spring forward. This action is readily apparent from animal toys such as those shown and described in U.S. Pat. Nos. 2,824,409; 2,663,970; 2,636,317; and 4,816,002. U.S. Pat. No. 3,190,035 uses coil springs to produce a like effect. U.S. Pat. No. 5,205,775 uses a skeleton, and seeks to allow the legs to rotate about substantially horizontal axes.

In the case of the present toy animal, a rocking or toddling motion is produced which simulates the waddling scamper of a young puppy. As the toy animal is pulled forward, the body tends to move forward and pivot relative to the hinged legs and to rise somewhat. The tops of the legs will tend to move forward about their hinge points and relative to the associated feet or paws which are restrained due to their frictional engagement with the surface against which they bear. When a foot breaks loose (due to overcoming frictional resistance, and other force factors), the associated front leg will swing forward and outwardly relative to the other front leg because of the angles at which the front legs are hinged and connected to the body.

Which of the front feet releases and moves first and how they move is somewhat random due to manufacturing differences in the toy animals, and due to the angle and direction of the pulling on the leash, the weight distribution, the friction between the paws and the surface against which they bear, the speed with which it is drawn along the support surface, etc. The forward and outward movement of the leg causes a slight weight transfer to that front leg. This in turn tends to cause the other front leg to overcome the frictional resistance of the surface against which it bears, causing it to move forward and outwardly to cause a weight shift towards that side. A continuing repetition of the weight shift causes a side to side and back and forth rocking motion as the animal is moved forwardly. As the animal rocks, the back legs will catch and drag (and may swing as well). The overall rocking motion much more closely simulates a waddle and the motion of an animal, such as a young puppy, than does the motion resulting from the spring operated legs of the prior art patents referred to above.

It might also be mentioned that the rocking motion tends to cause the ears to bounce and the tail to wag, enhancing the animated, life-like effect of the toy animal.

In accordance with one form of the present invention, the toy animal is desirably provided with a supplemental weight low in the body just ahead of the hinge points of the rear legs, so as to balance the weight of the head and to keep the rear portion of the animal downwardly acting against the legs, hence against the surface on which it is moving, thereby helping to maintain the stability of the system. The front legs are connected to the body by being affixed to permit hinged movement of the legs relative to the body portion, thereby to simulate the walking action. On their foot or paw portions, the legs are provided with material which provides a gripping or skid-resistant configuration to create substantial friction that will tend to restrain the feet from moving relative to the supporting surface on which the toy is pulled for a short time prior to its release. Due to normal inexactness of construction in manufacture and for other reasons referred to above, one leg will release before the other, setting in motion the rocking motion. Once begun, due to the distribution of the weight with respect to the hinges, this motion continues.

The front legs are desirably slightly splayed, providing a wider base at the front of the animal, and producing stability, thereby to prevent the rocking motion from becoming too pronounced and causing the animal to tip over. The stability and the rocking resulting from the hinged legs and gripping feet creates the unique life-like motion. The child pulls the animal using a leash that is connected to a properly positioned hook attached to the lower front portion of the animal's body so that during the pulling action the animal is pulled at the proper angle to facilitate the walking motion. If the force is applied at too low an angle, the animal tips forward. If the force is applied at too high an angle, that tends to lift the front legs off the ground disrupting the interactive system.

As will be seen from the drawings, the novel design to accomplish the desired effect is incorporated within the toy animal.

BRIEF DESCRIPTION OF THE DRAWINGS

FIG. 1 is a perspective view showing a toy animal of the present invention in first and second walking positions;

FIG. 2 is a section taken along line 2—2 of FIG. 1;

FIG. 3 is a plan view of the animal in the first and second walking positions shown in FIG. 1;

FIG. 4 is a view of the animal of FIG. 1 in two walking positions as viewed from the side of FIG. 1 (these two positions have been exaggerated for illustrative purposes); and FIG. 5 is a view showing the position of the animal when initially pulled from the position shown in FIG. 4.

DESCRIPTION OF A PREFERRED EMBODIMENT

Figure 1A:
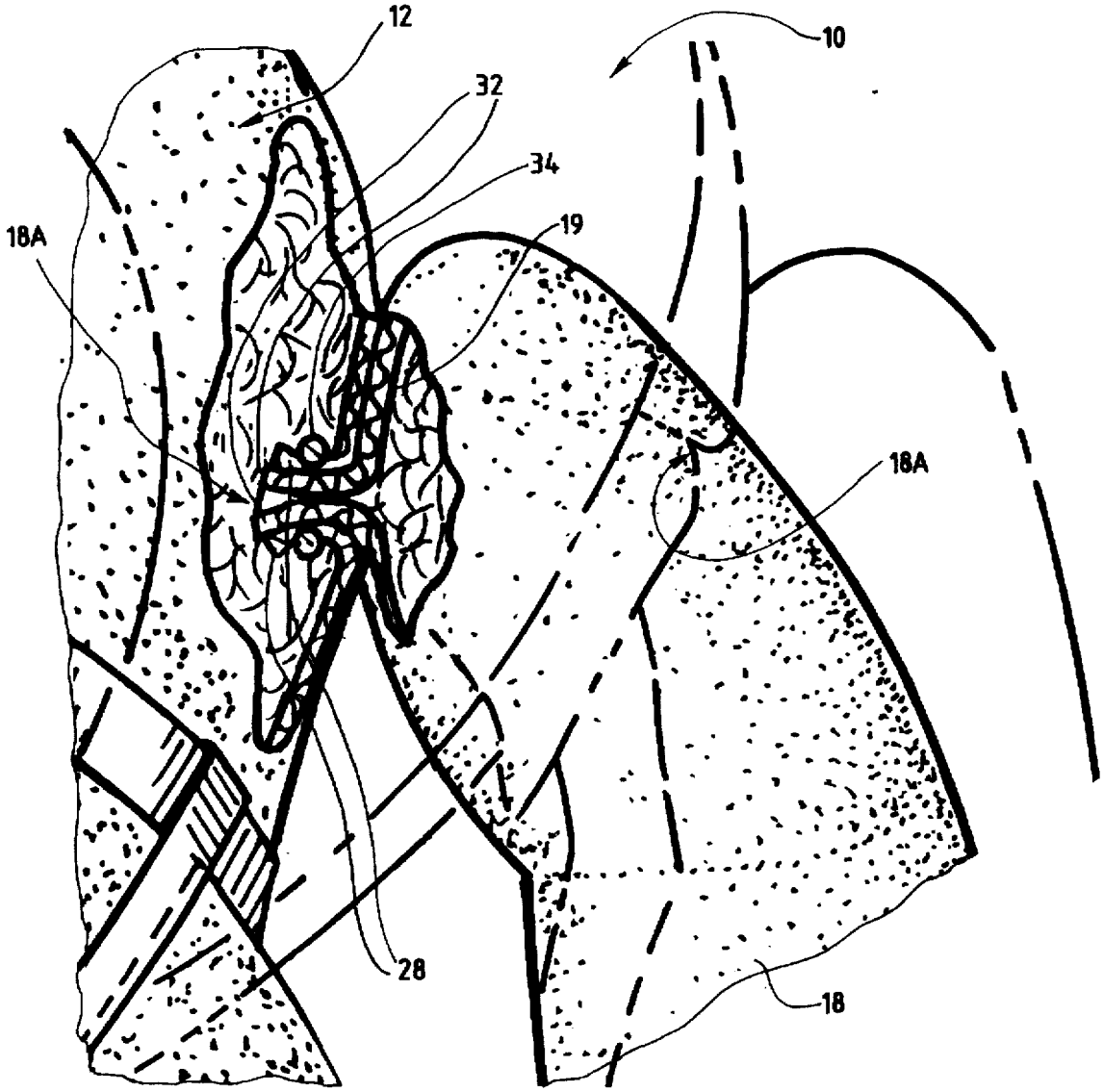
FIG. 1A is an enlarged portion of FIG. 1.

Referring first to FIG. 1, there is shown the perspective view of a toy animal 10 which in the illustrated embodiment is a small dog such as a puppy. The dog 10 includes a soft body portion 12 made of a sewn fabric 14, such as a plush fabric, which is filled with a stuffing material 16 of any conventional type to give the dog a relatively soft, cushy feeling. The body 12 has hinged legs 18. Legs 18 comprise leg fabric 19 that is also filled with a stuffing material 16.

The head portion 20 has attached thereto ears 22 each of which may include a weight 23. As shown by the drawings, the head portion 20 is affixed to the upper front part of the body portion 12, with the overall center of gravity of the body and head positioned to the rear of the front leg hinges in plan view.

Each of the legs 18 is hinged to the body, as is illustrated in the partially broken away section of FIGS. 1 and 1A. The fabric hinge connections are elongated as shown most clearly by the leg hinge lines 18A (see FIGS. 3, 4 and 5). The hinge connections consist of inturned flaps 28 which are portions of the body fabric and end portions 32 of the leg fabric 19 which are sewn together, as by thread 34. These connections which provide the hinges 18A retain the legs 18 relative to the body 12, and permit the legs 18 to swing relative to the body to effect the walking action when the toy is pulled along the ground.

The front legs 18 are secured to the body 12, as by the same threaded, stitched connections shown in FIG. 1. In plan view, the front leg hinge connections extend from near the front center of the body 12, and outwardly and rearwardly therefrom. Thus, in plan view, the front leg hinges are outwardly diverging as shown in dotted line in FIG. 3. The hinge connections are elongated, and provide a wide hinge between the body and the legs for separately swingably securing each front leg to the body so that each front leg swings about an axis which is at a substantial angle to the longitudinal axis of the animal. The angle at which the hinge connections extend, in plan view, will vary with the animal to be mimicked, but in all cases, in plan view the hinge connections are at a substantial angle of divergence from the front to the rear, as is illustrated by FIGS. 4 and 5, and as represented in dotted line in FIGS. 1 and 3. In FIGS. 1 and 3, the hinge connections are shown in dotted line, as compared to FIGS. 4 and 5, because the bulbous shape of the body which, in top plan view, hides the hinge connection in FIG. 3 and which positions the hinge connection in FIG. 1 beneath the decorative harness 46. It is a combination of these angles of hinged connection of the legs, the non-resilient wide, free-swinging hinges produced by the elongated fabric hinge connections between the body 12 and the front legs 18 and the absence of the resilient or elastic or springlike connections of the legs and bodies of the prior art which produces the characteristically unique motion of the toy animals of the present invention.

As shown in FIGS. 1 and 1A, the legs 18 are hinged to the body 12 and, in their rearward positions, bear against the body 12 at the upper portions of the legs adjacent to the hinges. Thus, although as is apparent from the drawings the legs swing about their hinged connections relative to the body, eventually the upper back portions of the legs will bear against the body creating a force component between the legs 18 and the body 12. This force component, together with other forces applied against the toy animal, will eventually overcome the frictional resistance of the skid resistant feet and, as has been explained, the legs will move forwardly producing the characteristic motion described above.

Attached to the rear of the body 12 is a tail 24. In the illustrated embodiment, tail 24 is also filled with a stuffing material 16, although stuffing is not necessary. Shown in outline form is a weight 26 that is located in the rear portion of the body 12. The positioning of the weight 26 to the rear of the animal provides a wider range of workable leash angles of pull and provides greater stability for the toy animal as it is pulled forwardly.

The lower portions of the legs 14 have rounded skid-resistant paw or foot sections 36 having a gripping surface such as a material of high friction, or one having a series of bumps 38 or a fabric with a roughened adhesive disposed thereon, or a fabric foot pad with a non-skid vinyl applied to it. These materials create a high friction action between the feet and the surface on which the dog is supported and is being pulled. The combination of the low center of gravity of the animal, weight distribution and the skid-resistant rounded bumpy foot sections 36 retains the legs in position relative to their support and restrains them until a certain amount of pulling force is applied, at which time they will move to simulate the walking action described above.

When the toy dog 10 is to be walked, it is pulled by a leash 40 that is connected to a spring clip 42 which in turn is connected to the body 12. A harness ring 44 affixed to a harness 46 may be used or the harness may be decorative, in which case the leash or clip or harness ring may be secured directly to the body 12, most preferably between the front legs 18 and adjacent to the hinge lines 18A connecting the front legs 18 to the body 12. Thus, typically, the center of gravity of the toy animal is directly behind the point of connection. The positioning of the spring clip is such that the force is applied to the most stable location on the body of the animal. In addition, a semi-rigid stiffening tube 47 may surround or comprise the leash 40 giving additional control to the child.

It is to be noted that a tail 24 is connected to the rear portion of the body 12 in the manner shown in FIG. 2. As can be seen in FIG. 2, the tail 24 is made up of a stuffing filled fabric 48 including tail portions 50 that extend through an opening 51 in the rear end of the dog body 12. Surrounding the opening 51 are flaps 52 formed from the rear portion of the body fabric 14. The tail portions 50 are sewn to flaps 52 in position by threads 54. The tail is thus free to move relative to the body by virtue of this hinged connection.

While a dog or puppy has been illustrated, the principles of the present invention could apply equally well to other animals, such as the four-legged animals and other animals that incorporate the novel features disclosed herein.

It is intended to cover by the appended claims all such features and embodiments that fall within the true spirit and scope of the present invention.

What is claimed is:

1. A toy walking animal comprising a filled unitary fabric body section, a head assembly and two front legs, each front leg being separately hinged to said body by a hinge along an elongated hinge line, each said hinge line extending, when viewed in top plan view, from adjacent the front center of said body and rearwardly outwardly along said body, thereby separately swingably securing each front leg to said body and so that each front leg swings about an axis which is at a substantial angle to the longitudinal axis of the animal, and characterized by the absence of any flexible springlike member connecting the body and the front legs, each said front leg having a foot at its base, each said foot comprising a skid-resistant gripping surface for providing a high degree of friction between said foot and a support surface, and leash means secured to said body between said front legs and between said front leg hinges for pulling said animal along a support surface, whereby when the animal is pulled it will appear to be walking.

2. A toy walking animal as set forth in claim 1, and wherein said means for individually hinging each of said front legs to said unitary body section consists of end fabric portions of each leg disposed through an opening defined by flaps of said body fabric, and means for connecting the leg end portions and body flap portions to hingedly secure the front legs in position.

3. A toy walking animal as set forth in claim 1 in which the means for pulling the toy animal includes a harness disposed about the lower part of the unitary body section, and said leash means includes a semi-rigid section.

4. A toy walking animal as set forth in claim 1 in which the head assembly is affixed to the upper part of the body portion, the major portion of the body being disposed to the rear of the ends of the front legs to aid in the walking motion of the animal.

5. A toy walking animal as set forth in claim 4 in which the head assembly includes depending ears.

6. A toy walking animal as set forth in claim 1 in which the gripping surfaces consist of a series of skid resistant bumps.

7. A toy walking animal as set forth in claim 1 including a tail portion and means for hinging the tail to the body portion.

8. A toy walking animal in accordance with claim 1, further comprising at least one rear leg hinged to said body and having a foot at its base, said foot comprising a skid-resistant gripping surface for providing a high degree of friction between said foot and a support surface.

9. A toy walking animal in accordance with claim 1, and further comprising two rear legs, each rear leg being separately hinged to said body by a hinge along an elongate hinge line, each said hinge line separately swingably securing each rear leg to said body, and characterized by the absence of any flexible springlike member connecting the body and the rear legs, and each said rear leg having a foot at its base, each said foot comprising a skid-resistant gripping surface for providing a high degree of friction between said foot and a support surface.

* * * * *